US006316713B1

(12) United States Patent
Fürst et al.

(10) Patent No.: US 6,316,713 B1
(45) **Date of Patent: *Nov. 13, 2001**

(54) SOUND PICKUP SWITCHING APPARATUS FOR A STRING INSTRUMENT HAVING A PLURALITY OF SOUND PICKUPS

(75) Inventors: Werner Fürst, Zürich; Michael Boxer, Erlenbach, both of (CH)

(73) Assignee: Boxer & Fürst AG, Zürich (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/189,007

(22) Filed: Nov. 9, 1998

(51) Int. Cl.[7] ..... G10H 3/18
(52) U.S. Cl. ..... 84/726; 84/728
(58) Field of Search ..... 84/726–728, 477 R, 84/478, 267, 470 R

(56) References Cited

U.S. PATENT DOCUMENTS 3,915,048 * 10/1975 Stich ..... 84/728
4,151,776 5/1979 Stich .
4,175,462 * 11/1979 Simon ..... 84/728
4,613,985 9/1986 Hashimoto et al. .
4,711,149 12/1987 Starr .
4,733,591 * 3/1988 Kaneko et al. ..... 84/470 R
4,773,294 * 9/1988 Iizuka et al. ..... 84/477 R
5,136,919 8/1992 Wolstein .
5,299,282 3/1994 Tabei .
5,300,727 * 4/1994 Osuga et al. ..... 84/477 R
5,311,806 * 5/1994 Riboloff ..... 84/728
5,399,800 3/1995 Morita et al. .
5,763,808 * 6/1998 Thomson ..... 84/728
5,780,760 * 7/1998 Riboloff ..... 84/726

* cited by examiner

*Primary Examiner*—Stanley J. Witkowski
(74) *Attorney, Agent, or Firm*—Cohen, Pontani, Lieberman & Pavane

(57) ABSTRACT

A sound pickup switching apparatus for a string instrument having a plurality of sound pickups, in particular for an electric guitar. The apparatus includes an operable switching device which is intended to connect the coils of the sound pickups in different combinations in order to produce an output signal of different tonality. A voice signal production apparatus, depending on the respective state of the switching device, produces a voice signal designating the state. The string instrument includes a voice signal production apparatus which makes it possible to output states of the string instrument by voice.

5 Claims, 5 Drawing Sheets

| STATE | VOICE, TEXT |
|---|---|
| 1 | SWITCH NUMBER... |
| 2 | NECK AND BRIDGE |
| 3 | NECK AND... |
| 4 | ..... |
| 5 | ..... |
| | |
| | |
| | |

SOUND PICKUP SWITCHING APPARATUS FOR A STRING INSTRUMENT HAVING A PLURALITY OF SOUND PICKUPS

BACKGROUND OF THE INVENTION

1. Field of the Invention

The invention relates to a sound pickup switching apparatus for a string instrument, in particular an electric guitar. The invention furthermore relates to a method for adjusting a sound pickup switching apparatus for string instruments,. The invention still furthermore relates to a string instrument having a sound pickup.

2. Discussion of the Prior Art

Sound pickups for string instruments, in particular for electric guitars, normally have either one coil or else a so-called double coil which has two electrically separate coils arranged on the sound pick-up. Such a double coil is also called a "humbucker pickup". In electric guitars, a plurality of sound pickups are normally arranged spaced apart in the direction in which the strings run. The best known arrangements are the so-called "GIBSON tonality", which comprises two sound pickups with a double coil, and the so-called "FENDER tonality", which comprises three sound pickups, each having one coil. In addition, other arrangement variations of sound pickups are known, for example an arrangement in which a further sound pickup with one coil is arranged between two sound pickups each having a double coil and detects the oscillations of the strings.

WO-92/13335 discloses a sound pickup switching apparatus for an electric guitar, which allows the individual coils of a plurality of sound pickups to be connected in various combinations in order to play the electric guitar with different tonality. This known sound pickup switching apparatus has the disadvantage that both the number of the sound pickups which can be connected and their combination options are very limited.

SUMMARY OF THE INVENTION

The object of the present invention is to improve the range of selections and the operability of the sound pickup switching apparatus and of the string instrument.

A further object of the present invention is to provide a string instrument having more versatile capabilities.

The object is achieved in particular by a sound pickup switching apparatus which comprises an operable switching apparatus which is intended to connect the coils of the sound pickups in different combinations in order to produce an output signal of different tonality. The switching apparatus additionally comprises a voice signal production apparatus which, depending on the respective state of the switching apparatus, produces a voice signal designating the state.

The object is furthermore achieved in particular by a string instrument, such as a guitar for example, which comprises means for detecting a state of the string instrument as well as a voice signal production apparatus. The voice signal production apparatus produces a voice signal which describes the detected state with the aid of voice. The voice signal is fed to an electroacoustic transducer such as a loudspeaker or a headset, so that the voice signal can be listened to by the person playing the instrument and, possibly, by the public as well.

The string instrument according to the invention has the advantage that its states can be described by the use of a voice signal, so that the person playing the instrument is informed in a simple and pleasant manner of the respective state of the string instrument. An electronic guitar may have a multiplicity of different states, for example the wiring of the coils, the charge state of the battery, the setting of the volume control, connected filters etc., whose respective state can be described by the voice output. If, for example, the battery is virtually discharged, then this state can be described by the "battery low" voice signal, and can be output via the loudspeaker.

The string instrument and the sound pickup switching apparatus always require a voice signal production apparatus. There are a wide range of options for the design of the other components, as a mechanical switch in one simple embodiment or comprising a microcomputer in a high-performance embodiment.

The switching apparatus may be designed as a mechanical switch which has a plurality of permanently preset combination options for the coils of the sound pickups. The switch is operated to select one of the permanent preset connections and the individual coils being connected to one another accordingly. The signal from the coils connected in such a manner are passed to a downstream electroacoustic transducer, in particular a loudspeaker. In addition, the selected switching state is passed to a voice production apparatus which produces a voice signal that describes the selected state in words. This voice signal is preferably passed to the loudspeaker mentioned above, it also being possible to output the voice signal via an additional electroacoustic transducer, for example via a headset or a built-in loud-speaker in the guitar.

In a refinement of the invention, the sound pickup switching apparatus has an electronic drive apparatus with switches which can be controlled selectively, it being possible to connect any coil to a switch. The switches are designed to be electromechanical, for example comprising an electromagnet and a make contact, or electronic, for example comprising only an FET transistor.

In a preferred embodiment, the drive apparatus is designed to be programmable and, in addition, has a plurality of memories, each of which can be used to store one connection combination of coils. During a programming process, one connection combination can be selected, for example, from a large number of possible coil connections and can be assigned to a memory, it being possible to activate the drive apparatus or the memory, for example, via a push-button switch arranged on the guitar. A guitar may have, for example, six push-button switches, it being possible to assign a connection combination in a freely programmable manner to each push-button switch. One advantage of the apparatus according to the invention is that the preferred connection combinations can be assigned as required to the push-button switches, and thus it is possible to switch over very quickly between connection combinations programmed in such a manner, by operation of the respective push-button switch.

A further advantage of the apparatus according to the invention is that a connection combination, in particular the current function of a push-button switch, can be interrogated in a simple manner by means of a voice output. A further advantage is that the voice output can be produced via the same loudspeaker that is also used to output the sound signal from the guitar.

In a preferred embodiment, the programming process is likewise output by a voice signal in which, for example, instructions for the required inputs or the stored settings are described and output via the loudspeaker during the programming process by means of appropriately selected words.

One advantage of the apparatus according to the invention is that the output of a voice signal considerably simplifies the operation of the sound pickup switching apparatus for a guitarist, since any state of the switching apparatus can be interrogated in a simple manner, and since the preferred combinations of coils, or the preferred tonalities, can be assigned to the push-button switches in a simple manner by a programming process.

One advantage of the sound pickup switching apparatus according to the invention is that the loudspeaker which is always required for an electric guitar can also be used for the output of the voice signal, so that no additional display apparatus, in particular no visual display, is required. The acoustic signal in addition has the advantage that the guitar can be programmed in widely different light conditions, even in darkness or with the eyes closed. Furthermore, the guitar can also be operated by people with visual impairments, such as the blind.

A further advantage is that programming is carried out in a very acceptable manner by setting a connection combination of coils in a first phase, the voice signal stating which programming step is currently being carried out or stating the connection combination, and in that, in a second phase, the selected tonality can be listened to directly by operating the strings. If the tone does not have the desired tonality, the programming mode can be used to select directly a further connection combination, which can once again be listened to by operating the strings. The function of the push-button switches with different connection combination can thus be carried out very quickly and conveniently.

A further advantage is that an original signal produced by the sound pickups is available as the output signal of the guitar, without any preamplication or distortion, and thus uncorrupted.

The various features of novelty which characterize the invention are pointed out with particularity in the claim annexed to and forming a part of the disclosure. For a better understanding of the inanition, its operating advantages, and specific objects attained by its use, reference should be had to the drawing and descriptive matter in which there are illustrated and described preferred embodiments of the invention.

BRIEF DESCRIPTION OF THE DRAWINGS

The invention is described in detail using an exemplary embodiment. In the figures.

DETAILED DESCRIPTION OF THE PREFERRED EMBODIMENTS

Figure 1:
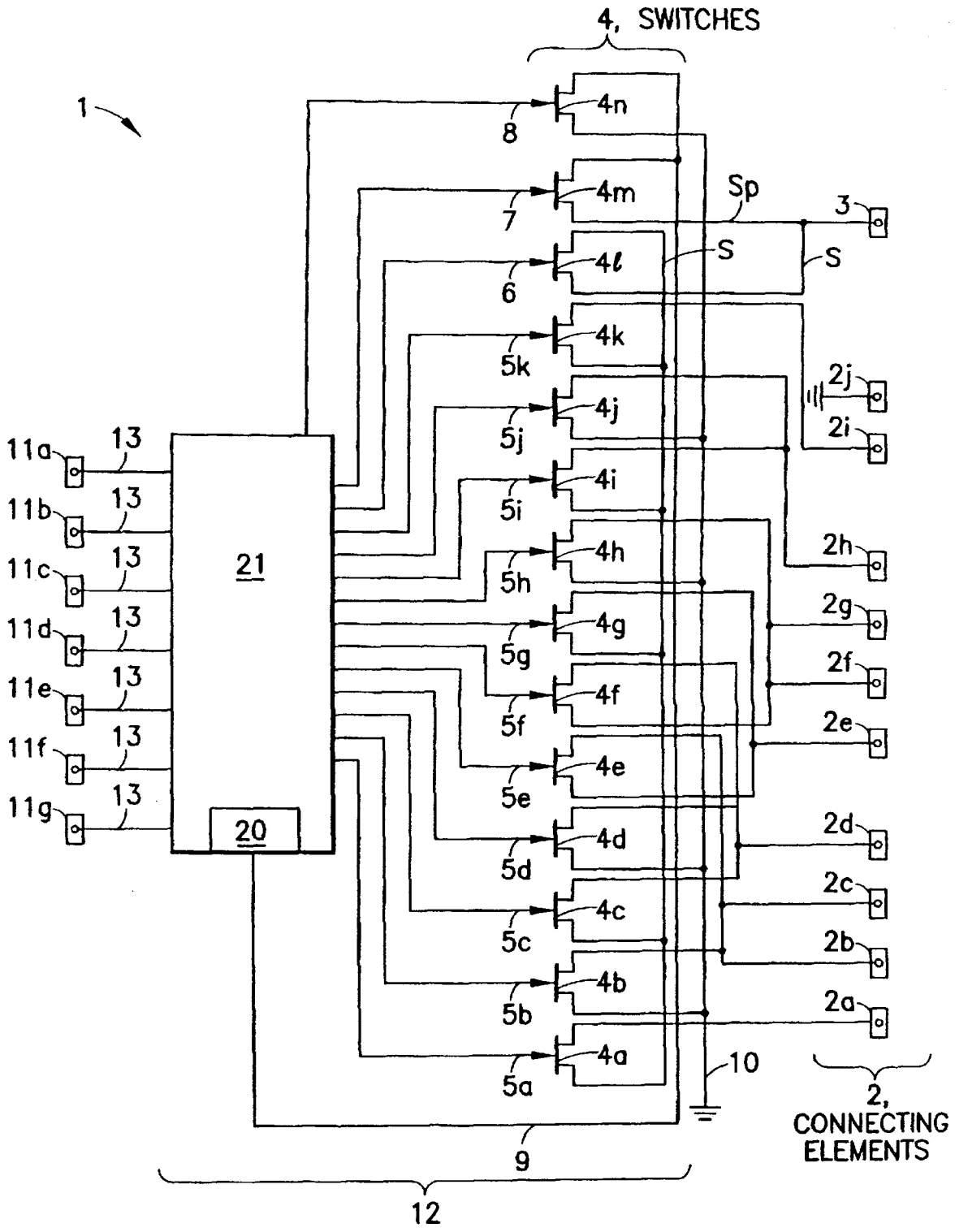
FIG. 1 shows a circuit diagram of a sound pickup switching apparatus.
Figure 2:
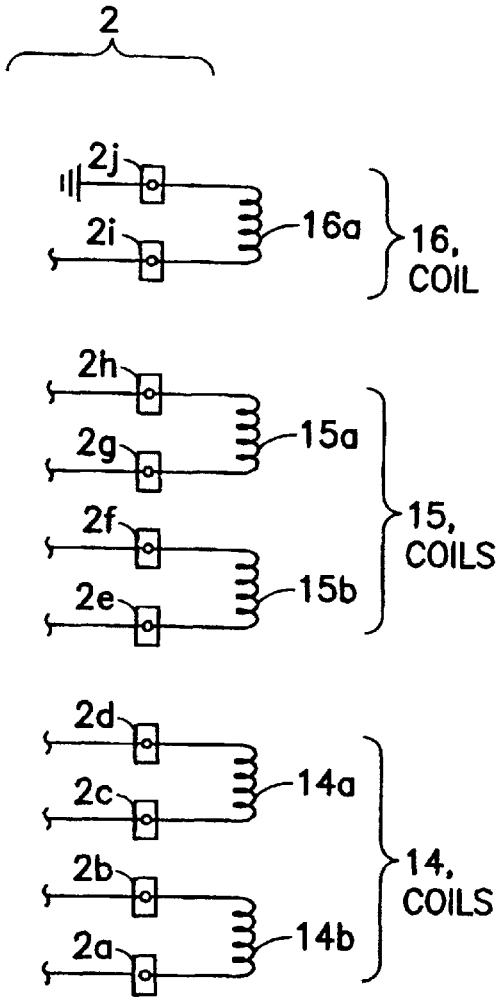
FIG. 2 shows a configuration of sound pickups for GIBSON tonality.

The electrical circuit diagram of a sound pickup switching apparatus 1 illustrated in FIG. 1 has a plurality of electrical connecting elements 2, each of the connecting elements 2*a*, 2*b*, 2*c*, 2*d*, 2*e*, 2*f*, 2*g*, 2*h*, 2*i*, 2*j* being designed, for example, as a terminal apparatus or as a plug, in order to produce an electrically conductive connection to the coils 14*a*, 14*b*, 15*a*, 15*b*, 16*a*, 17*a*, 18*a*, 19*a* from sound pickups 14, 15, 16, 17, 18, 19 arranged on the guitar. The connecting element 2*j* is grounded and the connecting elements 2*a*, 2*b*, 2*c*, 2*d*, 2*e*, 2*f*, 2*g*, 2*h*, 2*i*, 2*j* are connected to switches 4 via electrical conductors, some of which, as illustrated, are also connected to one another. The individual switches 4*a*, 4*b*, 4*c*, 4*d*, 4*e*, 4*f*, 4*g*, 4*h*, 4*i*, 4*j*, 4*k*, 4*l*, 4*m*, 4*n* are configured as field-effect transistors (FET transistors). These switches 4*a*, 4*b*, 4*c*, 4*d*, 4*e*, 4*f*, 4*g*, 4*h*, 4*i*, 4*j*, 4*k*, 4*l*, 4*m*, 4*n* could also be configured in another manner, for example as controllable electromagnetic relays. The switches 4*a*, 4*b*, 4*c*, 4*d*, 4*e*, 4*f*, 4*g*, 4*h*, 4*i*, 4*j*, 4*k* can be driven individually via switching signal lines 5*a*, 5*b*, 5*c*, 5*d*, 5*e*, 5*f*, 5*g*, 5*h*, 5*i*, 5*j*, 5*k* and are connected to a drive apparatus 21. This arrangement of switches 4 allows the coils 14*a*, 14*b*, 15*a*, 15*b*, 16*a*, 17*a*, 18*a*, 19*a* of the sound pickups 14, 15, 16, 17, 18, 19 to be combined in a very wide range of ways, as is illustrated in more detail in the example of the configuration of sound pickups in FIG. 2. The configuration of sound pickups 14, 15, 16 for GIBSON tonality has two sound pickups 14, 15 each having two coils 14*a*, 14*b*, 15*a*, 15*b*, also called a double coil, as well as a sound pickup 16 with a single coil 16*a*. The individual coils 14*a*, 14*b*, 15*a*, 15*b*, 16*a* can, as illustrated, be connected to the corresponding electrical connecting elements 2*a*, 2*b*, 2*c*, 2*d*, 2*e*, 2*f*, 2*g*, 2*h*, 2*i*, 2*j*.

In the sound pickup switching apparatus 1, the electrical connecting elements 2*a*, 2*b*, 2*c*, 2*d*, 2*e*, 2*f*, 2*g*, 2*h*, 2*i*, 2*j* are wired up to one another as well as to the individual switches 4*a*, 4*b*, 4*c*, 4*d*, 4*e*, 4*f*, 4*g*, 4*h*, 4*i*, 4*j*, 4*k* in such a manner that the individual coils 14*a*, 14*b*, 15*a*, 15*b*, 16*a* can be interconnected in a large number of combinations by selective operation of the switches 4*a*, 4*b*, 4*c*, 4*d*, 4*e*, 4*f*, 4*g*, 4*h*, 4*i*, 4*j*, 4*k*, in order to produce an output signal S from the sum of the individual signals from the coils 14*a*, 14*b*, 15*a*, 15*b*, 16*a*. By way of example, a number of connection options for the two sound pickups 14, 15 to coils 14*a*, 14*b*, 15*a*, 15*b* are given in the following text, from the large number of possible combinations. For example, the output signal S could be produced by the following combinations of the coils 14*a*, 14*b*, 15*a*, 15*b*:

- coil 14*a* connected in parallel with coil 14*b*
- only coil 14*a*
- only coil 14*b*
- coil 14*a* connected in parallel with coil 15*b*
- coil 14*a* connected in series with coil 15*b*
- coil 14*b* connected in parallel with coil 15*a*
- coil 14*b* connected in series with coil 15*a*
- coil 14*a* connected in parallel with coil 14*b*, coil 15*a* connected in parallel with coil 15*b*, and both parallel circuits connected in series,
- only coil 15*a*
- only coil 15*b*
- coil 15*a* connected in parallel with coil 15*b*
- etc.

This large number of combinations can be set by the switching apparatus 12, which comprises the drive apparatus 21 and the switches 4. The drive apparatus 21 has a programmable microprocessor with a memory. The inputs to the drive apparatus are passed via the electrical connecting elements 11*a*, 11*b*, 11*c*, 11*d*, 11*e*, 11*f*, 11*g*, which are connected via signal lines 13 to the drive apparatus 21. For example, six push-button switches are arranged on a guitar, which can be operated individually by a slight pushing movement and are connected via a cable to the electrical connecting elements 11*a*, 11*b*, 11*c*, 11*d*, 11*e*, 11*f*, 11*g*. These push-button switches can be used to program the programmable switching apparatus 12, the respective state of the switching apparatus 12 being designated by a voice signal Sp which is generated by a voice signal production apparatus 20 connected to the drive apparatus 21 and is emitted to a voice signal line 9, corresponding to the state of the switching apparatus 12. In the illustrated exemplary embodiment, the voice signal production apparatus 20 forms part of the drive apparatus 21.

The output signal S is passed via a further switch 41, which can be driven by the drive apparatus 21 via a switching signal line 6. After the switch 41, the output signal S is passed to an electrical connecting element 3, where the output signal S is picked off and is normally fed to a downstream amplifier system with loudspeakers. The switch 41 allows the output signal S to be connected to or disconnected from the connecting element 3.

The voice signal Sp is passed via a further switch 4*m*, which can be controlled by the drive apparatus 21 via a switching signal line 7. After the switch 4*m*, the line which transmits the voice signal Sp is connected to the line which transmits the output signal S, and is passed jointly to the electrical connecting element 3. By appropriate control of the switches 4*l*, 4*m*, it is thus possible to pass only the output signal S, only the voice signal Sp or a superimposition of both signals S, Sp to the connecting element 3. The further switch 4*n* is used, with the switching signal line 8, to connect the voice signal Sp to ground 10 or, by additional switching of the switch 4*m*, also to connect the output signal S, which is present at the electrical connecting element 3, to ground 10.

One advantage of this arrangement and of the use of FET transistors is that the changeover takes place without any clicking, so that no clicking noises occur on the downstream loudspeaker.

Figure 3:
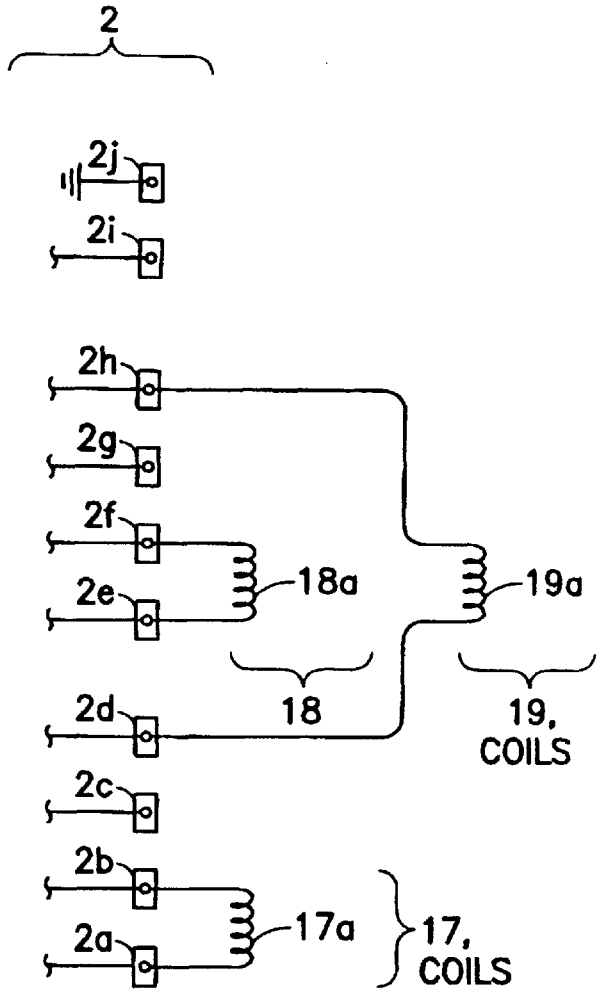
FIG. 3 shows a configuration of sound pickups for FENDER tonality.

FIG. 3 shows a further configuration of the sound pickups 17, 18, 19, which each have a single coil 17*a*, 18*a*, 19*a* and which are connected to one another via the electrical connecting element 2 for FENDER tonality and can be connected in different combinations, corresponding to the switching apparatus 12 options.

Figure 4:
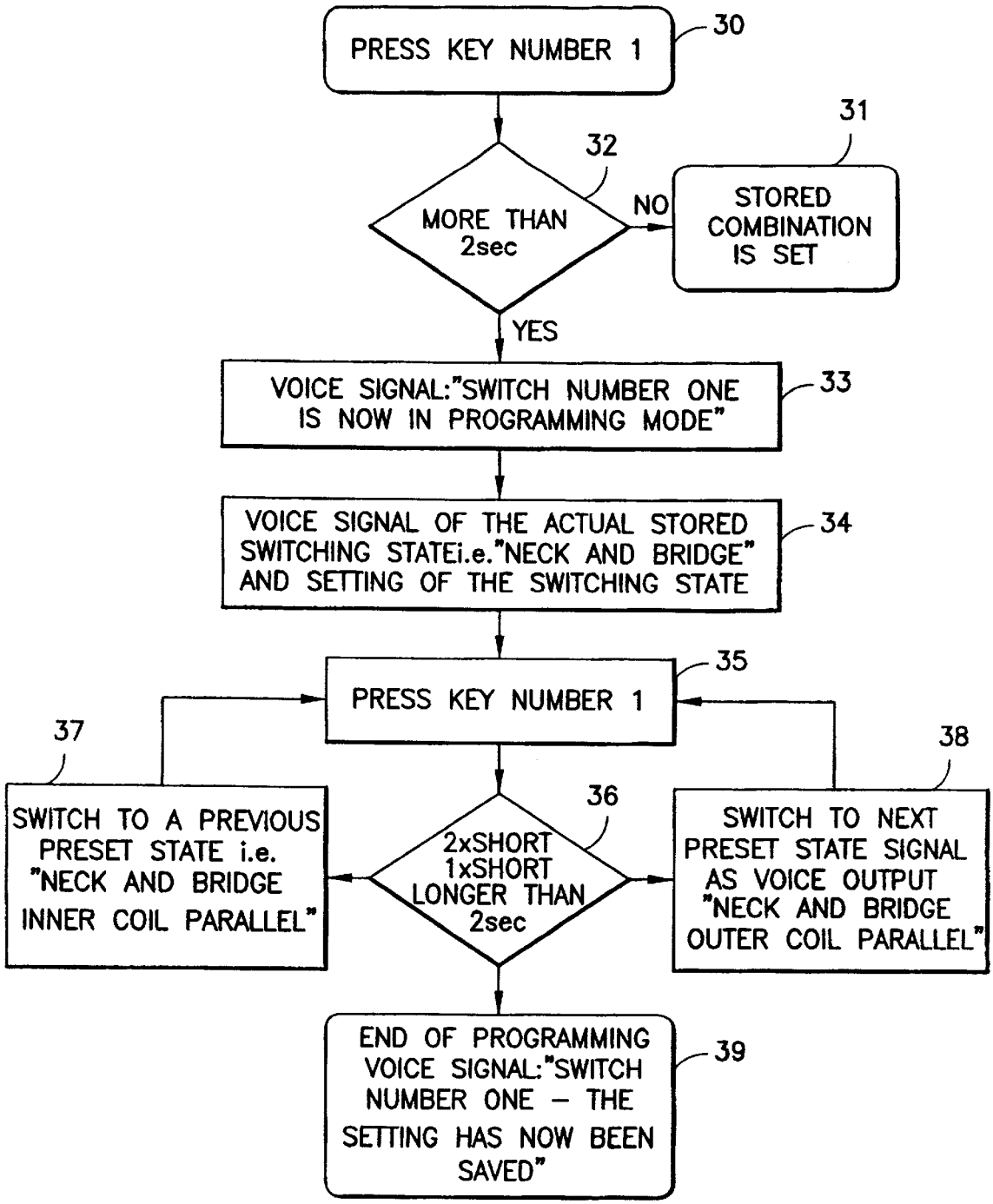
FIG. 4 shows a flowchart of a dialog during a programming process.

FIG. 4 uses a flowchart to show a programming process for the drive apparatus 21 for the switching apparatus 12. In method step 30, key number 1 is pressed, this key being arranged on the guitar, being designed as a push-button switch and being connected via the connecting element 11*a* to the drive apparatus 21. Key number 1 is assigned a memory, with a stored switching state of the switches 4, in the drive apparatus 21. In method step 32, the time for which the key is pressed is monitored and, if the key is pressed for less than two seconds, the process moves to method step 31. The state stored for key number 1 is applied to the individual switching signal lines 5*a*, 5*b*, 5*c*, 5*d*, 5*e*, 5*f*, 5*g*, 5*h*, 5*i*, 5*j*, 5*k* and is correspondingly connected to switches 4*a*, 4*b*, 4*c*, 4*d*, 4*e*, 4*f*, 4*g*, 4*h*, 4*i*, 4*j*, 4*k*, so that, when the strings are operated, an output signal S can be produced with corresponding interconnection of the coils 14*a*, 14*b*, 15*a*, 15*b*, 16*a*. In an analogous manner, switch number 2 and number 3 etc. can be operated to set the respectively stored switching state.

If the time for which the key is pressed in method step 32 exceeds two seconds, then the drive apparatus 21 changes to a program mode and, in the subsequent method step 33, a voice signal Sp is produced whose content is "switch number one is now in programming mode". Then, in method step 34, a voice signal Sp is output with the designation of the switching state contained in the memory at that time, for example by the message "neck and bridge", which means that the coil 14*a* is connected in parallel with the coil 14*b*, the coil 15*a* is connected in parallel with the coil 15*b*, and both parallel circuits are connected in series. The switches 4 are, in addition, connected in accordance with this memory content, so that the tonality of this output signal S can be listened to by operating the strings.

In a subsequent method step 35, the push-button switch with the key number 1 is pressed again, the time duration being monitored in method step 36. If the push-button switch is pressed once briefly, then a jump is made to method step 38 which causes the next state from a permanently preset list of switching states to be applied to the switches 4 and, in addition, to be output acoustically by a voice signal Sp as well, for example by the message "neck and bridge outer coil parallel". The newly set combination can once again be listened to by operating the strings. Pressing key number 1 briefly once again causes, after method step 36, a further jump to method step 38, so the next state stored in the permanently preset list of switching states is applied to the switches 4 and is at the same time output acoustically. It is thus possible to run through the list of preset switching states very quickly and conveniently and, if desired, to listen to them as well by operating the strings. As soon as a combination is set which it is desired to store, key number 1 must either be pressed for more than two seconds or there must be no more key inputs for more than 30 seconds, so that a jump is made from method step 36 to method step 39, which ends the programming process with the message "switch number one the setting has now been saved". The selected combination is thus stored and can be called up at any time by operating key number 1, as illustrated by method step 31. If the key is operated twice briefly in method step 36, then a jump is made to method step 37, and a jump back is made in the list of permanently preset switching states, that is to say a jump in the opposite direction to method step 36. Thus, in method step 36, it is possible by operating the push-button switch once or twice to jump forward or backward, respectively, in the permanently preset list of switching states.

The illustrated flowchart should be regarded as only one example of a large number of options of how the drive apparatus 21 could be programmed.

In addition, a visual display could also be used as an output means for displaying the switching states. Instead of or in addition to the push-button switches, other means could be provided as the input means, for example in which operation of the strings is detected by a sound pickup, and an input signal is produced from this. In this case, in each case one string is, for example, pressed so that it touches the sound pickup, the string normally being grounded and the contact in the sound pickup producing a pulse which can be detected by an appropriately designed electronic switching apparatus, in order to produce a switching signal. The contact between the string and the sound pickup must last, for example, for at least a quarter of a second or at least half a second, in order to be accepted as a switching signal. In this way, it is possible to distinguish between inadvertent contact with the sound pickup, as can occur while playing, and deliberate contact with the sound pickup. Furthermore, an electronic voice identification apparatus could also be used as the input means, so that the guitar can be programmed by spoken words.

In addition to the control of the switches 4, other components, such as capacitors, which influence the tonality of the output signal S, could also be driven in a programmable manner by the drive apparatus 21 in order to change the output signal S and to allow an even greater range of selectable tone variations.

Figure 5:
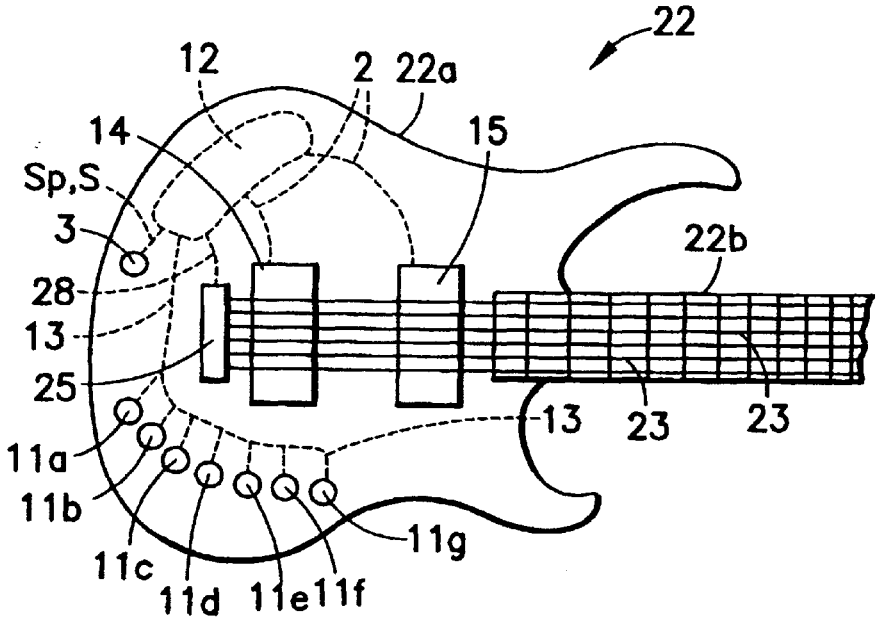
FIG. 5 shows a guitar according to the invention.

FIG. 5 shows a guitar 22 having a body 22*a*, a neck 22*b*, strings 23 and sound pickups 14, 15. Pressure or tension sensors are arranged in the bridge 25, which allow the stress in the individual strings 23 to be measured and the stress levels to be passed on by the signal line 28 to the switching apparatus 12. The programmable switching apparatus 12 is arranged inside the body 22*a* and is connected via electrical signal lines 2, 13, 28 to the coils 14, 15, to the sensors of the bridge 25, as well as to the operating switches 11*a*, 11*b*, 11*c*, 11*d*, 11*e*, 11*f*, 11*g*. The output signal S as well as the voice signal Sp of the switching apparatus 12 can be tapped off at the electrical connecting element 3, which is designed as a socket for a cable plug.

Figure 6:
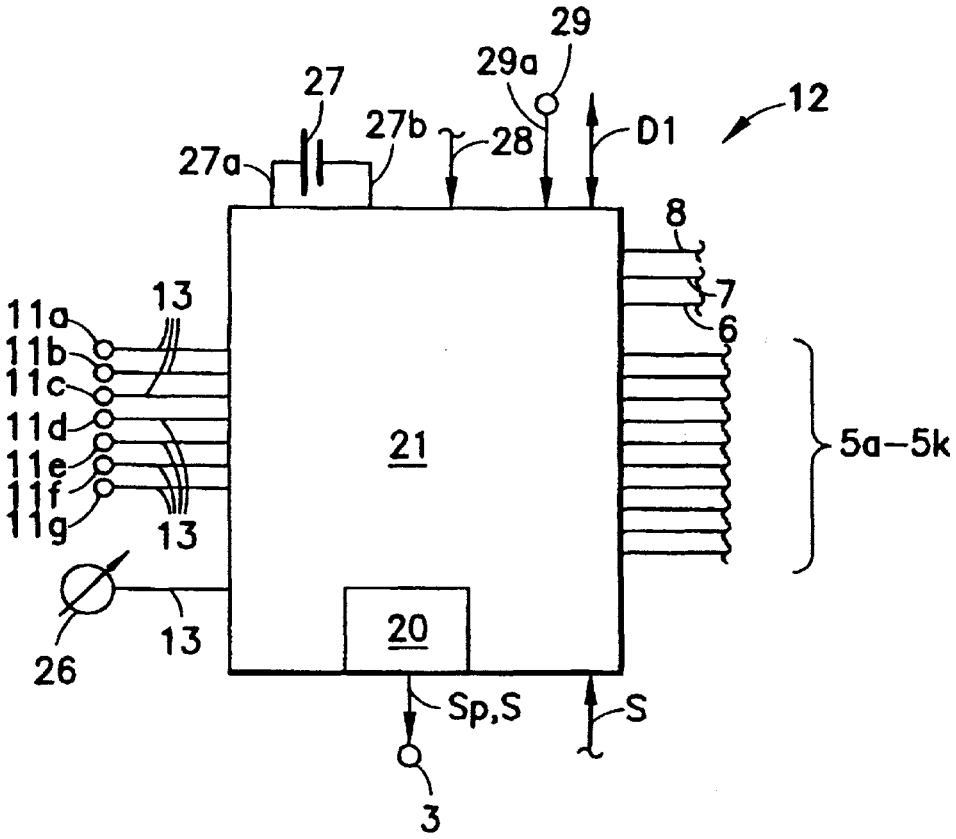
FIG. 6 shows a further exemplary embodiment of a programmable switching apparatus.

FIG. 6 shows a further exemplary embodiment of a programmable switching apparatus 12, which comprises a programmable drive apparatus 21 as well as a voice signal production apparatus 20. Various means are provided for detecting a state of a string instrument. These means may comprise the switches 11*a*, 11*b*, 11*c*, 11*d*, 11*e*, 11*f*, 11*g* which are connected via signal lines 13 to the drive apparatus 21. These means may furthermore, for example, comprise a regulator 26, a measurement apparatus for the voltage applied by the battery 27 to the lines 27*a*, 27*b*, a signal line 28 for a pressure or tension sensor, or the output signal S from individual coils or from all the coils. An electric guitar may have a large number of states, which can be detected using appropriately designed means and can be fed to the drive apparatus 21. The programmable switching apparatus 12, including the drive apparatus 21, may, as is illustrated by way of example in FIG. 7, comprise a microprocessor (CPU) 21*b* which is connected via data lines D2, D3, D4 to an input/output apparatus (I/O) 21*a*, to a memory 21*c* (RAM, ROM) and to the voice signal production apparatus 20. All the states of the lines 10, 13, 2*a*–2*j*, 6, 7, 8, 28, 29*a* are detected via the input/output apparatus 21*a*. The signal S from the coils 17, 18, 19 is detected via the lines 2*a*–2*j* and is fed as individual signals or as a sum signal S of the connected coils 17, 18, 19 by the input/output apparatus 21*a* to the voice signal production apparatus 20. In addition, data can be interchanged with an external apparatus via a data line D1 which is designed, for example, as a MIDI interface. The voice signal Sp as well as the signal S from the coils are output via the socket 3. The voice signal production apparatus 20 includes a table according to FIG. 8, in which various states and corresponding texts, voice or music signals are stored. The states may be stored as alphanumeric text, the voice signal production apparatus 20 allowing a synthetic voice signal Sp to be produced from this text. This voice signal Sp, which is initially in electrical form, is converted via an internal or external loudspeaker into an acoustic signal. The description of the states can also be stored as acoustic signals stored in digitized form, these signals being output as a voice signal Sp via a digital/analog converter. One advantage of storing the signals in digitized form is that it is possible to store signals with any desired content, even including entire welcoming texts, identifications, commentaries or else advertisements, which may include music as well as voice.

The string instrument designed as a guitar 22 allows, for example, the following states to be detected and to be output with a descriptive voice signal:

the connection of the coils 17, 18, 19, as already described in FIG. 1 and FIG. 4;

tone settings and corresponding pickup connection;

tone control, setting of the potentiometers 26, filters used as well as filter settings;

tone effects, distortion selected or frequencies additionally modulated on;

volume setting;

battery state; particularly when the battery is virtually discharged, it is possible, for example, to draw attention to this state by the "battery low" voice signal;

tuning of the strings. The frequency of the signal S can be analyzed, and the tuning of the string can be output using a voice output. At the same time, the voice output can also be used as an aid for tuning the strings, by outputting, for example, the statement "too high" or "too low" depending on whether the string is tuned to a frequency that is too high or too low. In addition, it would be possible to use the signal S to carry out a frequency analysis such that, for example, the chord being played is identified and is output by means of the voice output.

Figures 7, 8:
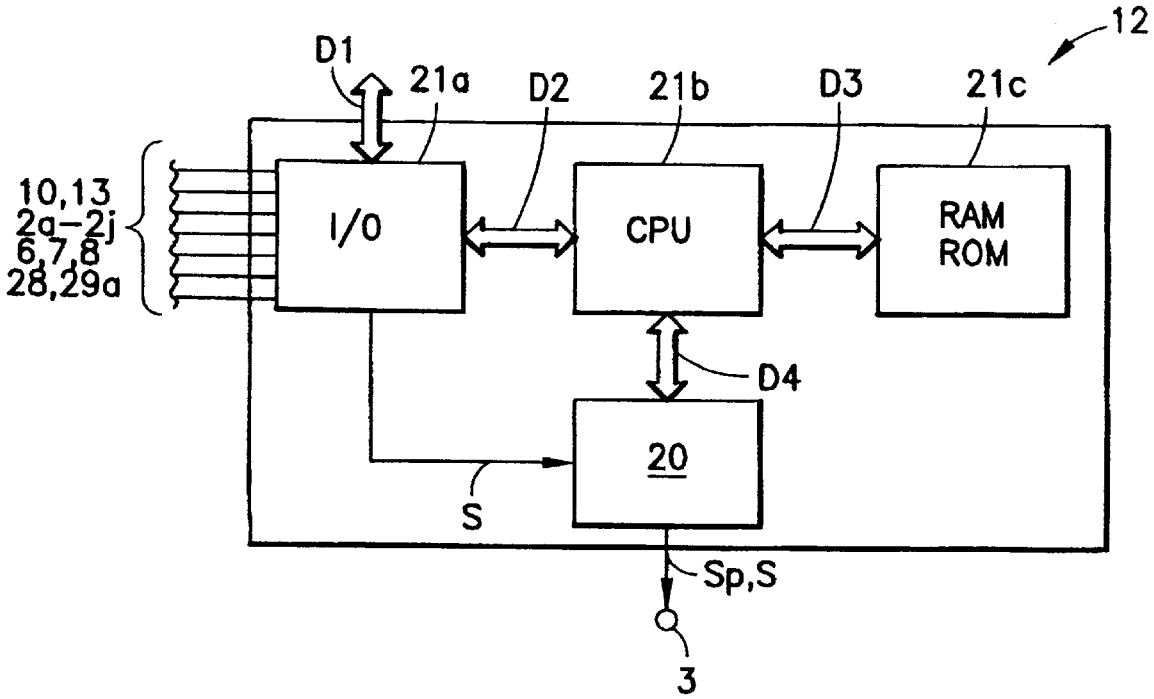
FIG. 7 shows a farther exemplary embodiment of a programmable apparatus.
FIG. 8 shows a table with states and an associated voice signal.

The programmable switching apparatus 12 may be externally programmable by, for example, connecting a computer to the external digital line D1, the table illustrated in FIG. 8 also being programmable with assignment of states and corresponding voice signals. The programmable switching apparatus 12 can also be designed without a digital line D1, in which case it is possible to provide, for example as illustrated in FIG. 6, an analog or digital input 29 via which, for example, a voice signal can be stored directly in the table according to FIG. 8, for example via a microphone. For example, a guitar player could very easily also store a welcome message directly via a microphone as a state in the table according to FIG. 8, and call it up at any suitable time by operating the switches 11*a*, 11*b*, 11*c*, 11*d*, 11*e*, 11*f*, 11*g*, and feed it as a voice signal Sp to a downstream loudspeaker.

The memory 21*c* arranged in the guitar may be designed as a read only memory (ROM), as a volatile memory (RAM) or as a magnetic memory such as a floppy disk, a hard disk, or an optical memory such as a magneto-optical disk, a compact disk or a minidisk.

The invention is not limited by the embodiments described above which are presented as examples only but can be modified in various ways within the scope of protection defined by the appended patent claims.

What is claimed is:

1. A string instrument, comprising:

a plurality of sound pickups; and a sound pickup switching apparatus including operable switching means for selectively connecting coils of the sound pickups in different combinations in order to produce an output signal of different tonality, voice signal production means for producing a voice signal designating the output state in words depending on a respective state of the switching means, means for detecting a state of the string instrument, and means for feeding the detected state to the voice signal production means, the voice signal production means including means for producing an appropriate voice signal as a function of the detected state, which voice signal can be fed to an electroacoustic transducer.

2. The string instrument as defined in claim 1, wherein the means for detecting a state of the string instrument include one of a switch, a regulator, a digital interface and a sensor.

3. The string instrument as defined in claim 2, wherein the means for detecting a state of the string instrument includes a sensor, the sensor being one of a coil, a tension sensor, a pressure sensor and a stress sensor.

4. The string instrument as defined in claim 1, wherein the means for feeding the detected state to the voice signal production means includes a microprocessor with an input/output apparatus and a memory.

5. The string instrument as defined in claim 1, wherein the voice signal production means includes a table in which various states and the voice signals corresponding to them are stored.

* * * * *